United States Patent [19]

McFarland

[11] 4,378,743

[45] Apr. 5, 1983

[54] PAPERBOARD PALLET HAVING INTERLOCKED RUNNERS

[75] Inventor: William M. McFarland, Georgetown, S.C.

[73] Assignee: International Paper Company, New York, N.Y.

[21] Appl. No.: 305,672

[22] Filed: Sep. 25, 1981

[51] Int. Cl.[3] ..... B65D 19/34

[52] U.S. Cl. ..... 108/51.3; 108/55.3; 108/56.3; 206/599

[58] Field of Search ..... 108/51.3, 56.3, 56.1, 108/55.1, 55.3; 206/386, 599, 600; 220/4 F

[56] References Cited

U.S. PATENT DOCUMENTS

| | | | |
|---|---|---|---|
| 2,534,011 | 12/1950 | Frye . | |
| 2,741,361 | 4/1956 | Klein . | |
| 2,841,350 | 7/1958 | Chronister . | |
| 2,894,671 | 7/1959 | Nicholls . | |
| 2,925,978 | 2/1960 | Marso . | |
| 2,953,339 | 9/1960 | Roshon . | |
| 2,958,494 | 11/1960 | Lovegreen | 108/51.3 |
| 3,514,030 | 5/1970 | Carroll . | |
| 3,557,719 | 1/1971 | Gielas | 108/51.3 |
| 4,303,020 | 12/1981 | Houle | 108/51.3 |

FOREIGN PATENT DOCUMENTS

| | | | |
|---|---|---|---|
| 2304532 | 10/1976 | France | 108/51.3 |

*Primary Examiner*—William E. Lyddane
*Attorney, Agent, or Firm*—Jay S. Cinamon

[57] ABSTRACT

The invention comprises a pallet constructed of a foldable material, such as corrugated paperboard, provided with a series of apertures in the bottom wall adapted to receive support blocks which are integrally attached to a plurality of runners which are disposed in spaced relationship upon the bottom wall. The corrugated paperboard is cut and scored in such a fashion as to permit it to be folded into a tray type pallet which serves to lock the plurality of runners, forming the rigid load-bearing deck of the pallet, into a fixed position.

1 Claim, 6 Drawing Figures

FIG. 3
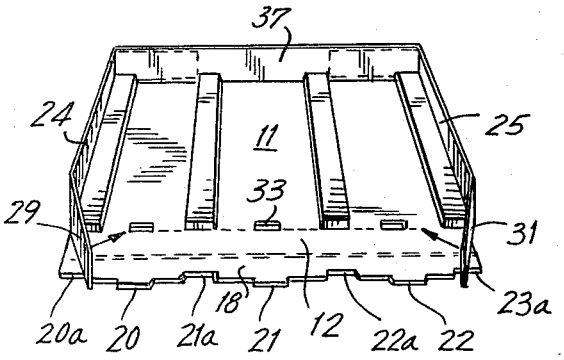
FIG. 4
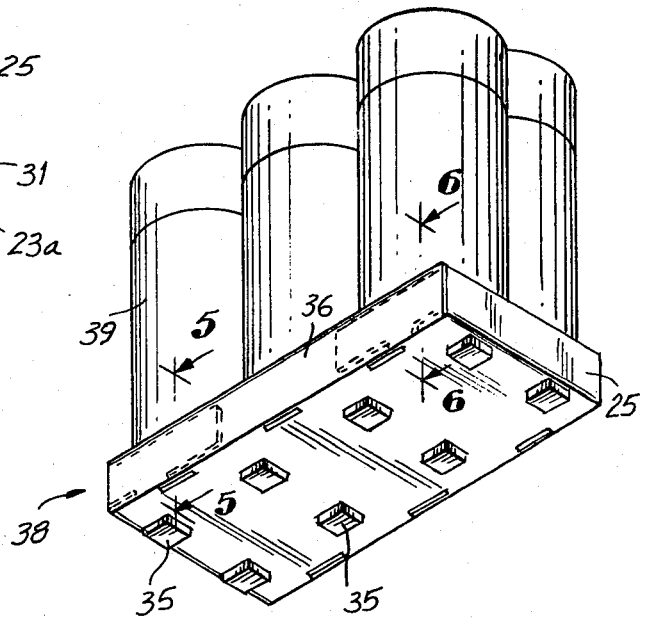
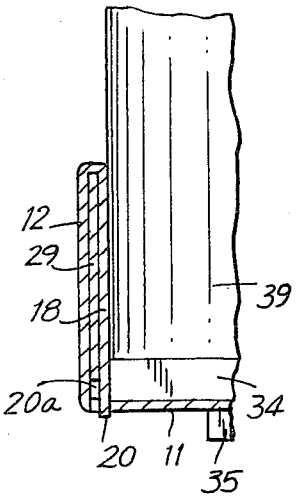
FIG. 5
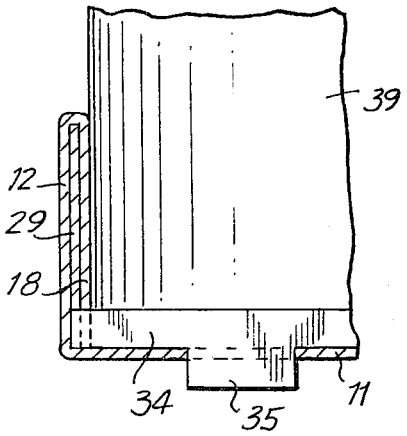
FIG. 6

PAPERBOARD PALLET HAVING INTERLOCKED RUNNERS

BACKGROUND OF THE INVENTION

1. Field of the Invention

This invention relates generally to pallets and, more specifically, to an improved pallet made of corrugated paperboard.

2. Description of the State of the Art

Historically, most pallets have been made of wood, which has made them quite costly and, because of their weight, cumbersome to employ in many materials handling applications. In an effort to reduce the weight of the pallet a variety of alternative materials have been employed. One such material that has been considered and used to some extent has been corrugated paperboard. While it is light in weight when compared with wooden pallets, it nonetheless provides a sufficiently strong construction to permit its use in many applications where wooden pallets are used conventionally. While corrugated pallets have attained some degree of acceptance, there are certain instances where only the added strength provided by wooden pallets can be utilized satisfactorily. In the present invention, a combination of corrugated board and wood provides a pallet which has a unique combination of properties.

The state of the art is best exemplified in the following U.S. Pat. Nos.: Frye, 2,534,011; Klein, 2,741,361; Chronister, 2,841,350; Nicholls, 2,894,671; Marso, 2,925,978; Roshon, 2,953,339; and Carroll, 3,514,030.

SUMMARY OF THE INVENTION

The instant invention comprises a pallet constructed of a foldable material, such as corrugated paperboard, provided with a series of apertures in the bottom wall adapted to receive support blocks which are integrally attached to a plurality of runners which are disposed in spaced relationship upon the bottom wall. The corrugated paperboard is cut and scored in such a fashion as to permit it to be folded into a tray type pallet which serves to lock the plurality of runners, forming the rigid load-bearing deck of the pallet, into a fixed position.

BRIEF DESCRIPTION OF THE DRAWINGS

FIG. 3 is another perspective view showing the assembly of the pallet of the present invention.

FIG. 4 is a perspective view of the assembled pallet bearing a load.

FIG. 5 is a sectional view along the line 5—5 of FIG. 4.

FIG. 6 is a sectional view along the line 6—6 of FIG. 4.

DETAILED DESCRIPTION OF THE INVENTION

Figure 1:
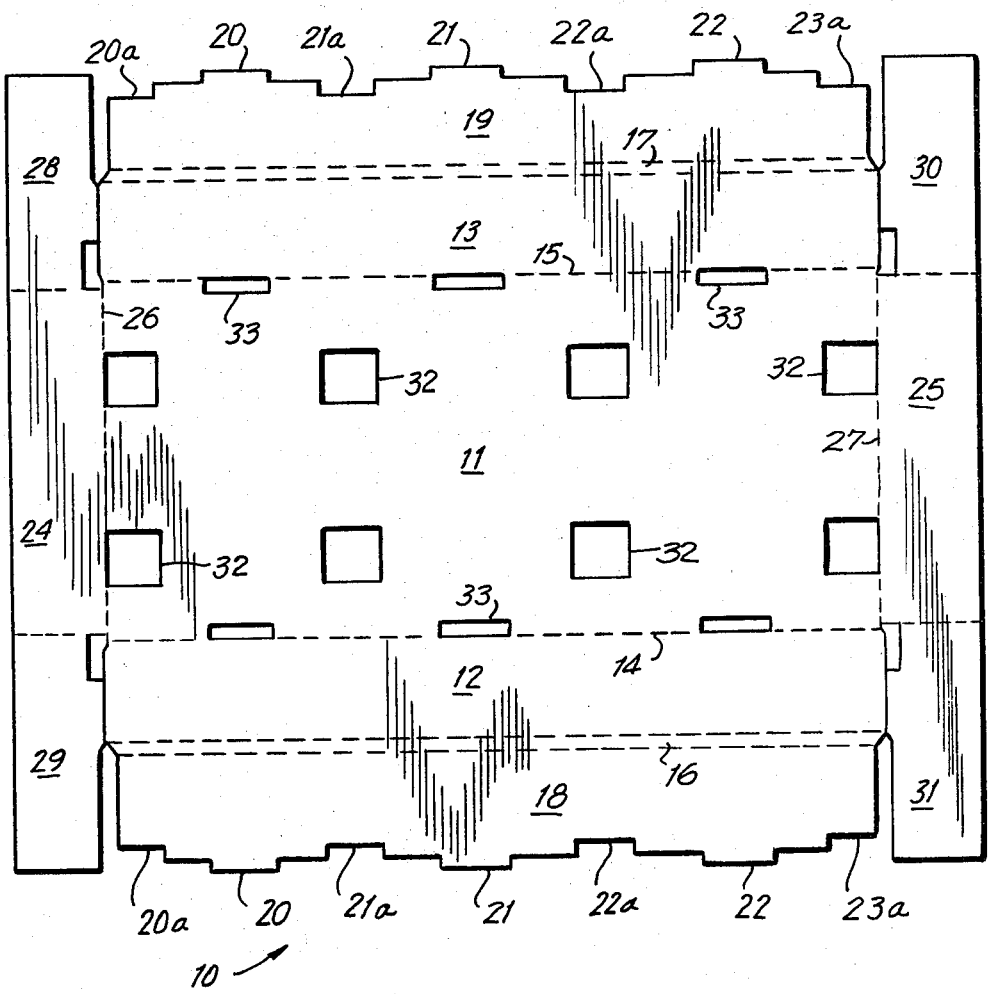
FIG. 1 is a plan view of a cut and scored blank forming the tray portion of the pallet of the present invention.

Referring to FIG. 1, there is shown a blank 10 of foldable sheet material which, for purposes of description, will be assumed to be a blank of corrugated paperboard. The blank 10 comprises a bottom wall 11 to which are hingedly connected first side panels 12 and 13, at the ends thereof, along score lines 14 and 15, respectively. Hingedly connected to first side panels 12 and 13 along double score lines 16 and 17, respectively, are second side panels 18 and 19. The free edges of second side panels 18 and 19 have a stepped configuration with the top steps forming tabs 20, 21 and 22, and the bottommost steps forming recesses, 20*a*, 21*a*, 22*a* and 23*a*, whose function will be described hereinafter.

End walls 24 and 25 are provided at the other end of bottom wall 11 and are hingedly connected thereto along fold lines 26 and 27. Each end wall 24 and 25 is provided with two end flaps 28, 29 and 30, 31, respectively, which are foldably connected to end walls 24 and 25 along continuations of fold lines 14 and 15.

Bottom wall 11 is provided with a plurality of apertures 32, which are depicted as having a square configuration. As will be apparent later in the specification, the configuration of these apertures are not, however, limited to any particular shape. In addition, while the number of apertures shown are eight, arranged in four vertically extending rows of two apertures each, the number and arrangement of the apertures are merely matters of choice depending, in the main, upon the ultimate use to which the pallet is put. Immediately adjacent fold lines 14 and 15, grooves 33 are provided to accommodate tabs 20, 21 and 22, which will be described hereinafter.

Figure 2:
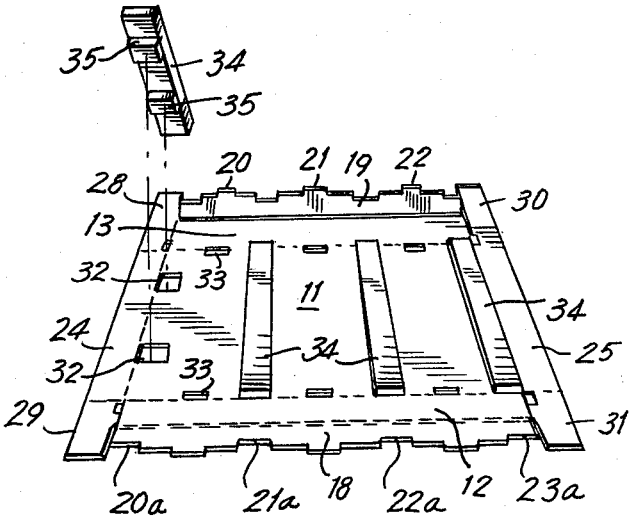
FIG. 2 is a perspective view of the partially assembled pallet of the present invention.

Turning now to FIGS. 2, 3 and 4, four runners 34 are shown, each of said runners having at least two integral support blocks 35. Obviously, the number of runners and blocks employed are clearly matters of choice. The blocks, which are preferably square, can also be rectangular or any other suitable shape, are adapted to be accommodated in the apertures. While the runners and blocks which are integral therewith can be made of a variety of materials, such as wood, rubber or plastic, it is preferred that they be made of wood to provide structural strength and rigidity. The blocks are preferably affixed to the runners by stapling, but other suitable means of affixation, such as gluing, can be used.

Blocks 35 on each of the four runners 34 are then placed into and through apertures 32 and, thereafter, the end panels 24 and 25 are folded upwardly about fold lines 26 and 27 until they are substantially perpendicular to the bottom wall 11. Then the end flaps 28–31, inclusive, are folded until they are coincident with and substantially perpendicular to score lines 14 and 15. Next, side panels 12, 18 and 13, 19 are folded upwardly about score lines 14 and 15 to a substantially perpendicular attitude and then second side panels 18 and 19 are folded downwardly and inwardly about double score lines 16 and 17 until the side panels are in face-to-face relationship with one another to form side walls 36 and 37. Sandwiched between panels 12 and 18 are end flaps 29 and 31 and sandwiched between panels 13 and 19 are end flaps 28 and 30. Finally, to secure the thus-formed tray type pallet 38 in an erect condition, tabs 20, 21 and 22 are inserted and locked into place in their mating grooves 33 and simultaneously the ends of runners 34 are locked into recesses 20*a*, 21*a*, 22*a* and 23*a* at either end of side walls 36 and 37.

As can be seen by reference to FIG. 4, the drums 39 or any other type of cargo, are placed upon the pallet 38 with the base of each of the drums resting upon the rigid deck formed by the runners and being contained within the confines of the pallet by the tray formed by the upstanding side walls and end walls. The blocks 35 form legs for the pallet and also afford entry to a two-way or four-way forklift truck between the blocks.

In FIG. 5 there can be seen the first and second side panels 12 and 18 of side wall 36 with the locking tab 20 emerging from the groove 33. Sandwiched between the two side panels is end flap 29. The tray formed in this manner is maintained in a positively locked condition at three sites along each side wall. By capturing the end flaps between the side panels forming the side walls, the side walls 36 and 37 along a significant portion of their length are of triple thickness corrugated which serves to reinforce and strengthen the tray-type pallet.

FIG. 6 illustrates the manner by which the runner 34 is maintained in a fixed position by its being seated in locking recess 20*a* to avoid lateral or vertical movement. Since the drums or any other cargo borne upon the tray-type pallet rests on the runners, it is important that the runners be maintained in a fixed position during transit to forestall any possibility of the cargo's shifting about and being damaged.

From the foregoing description of the invention, it can be appreciated that the present tray-type pallet represents an advance over prior pallets, since it provides an economical, light-weight, yet strong, pallet combining the respective advantages found in paperboard and wooden pallets. In addition, by using wooden blocks to support the pallet, the corrugated tray is maintained in an elevated condition off the ground and, thus, effectively separated from contact with any accumulated water which may be lying about which would damage the corrugated tray.

The specific and detailed information presented above was for the purpose of illustration only, and such alternatives, modifications, and equivalents thereof as would suggest themselves to those skilled in the art are deemed to fall within the scope and spirit of the invention, bearing in mind the invention is defined by the following claims.

What is claimed is

1. A pallet which comprises:

(a) a tray constructed of corrugated sheet material which comprises a bottom wall, a pair of first side wall panels foldably connected to said bottom wall at the ends thereof, a pair of second side wall panels foldably connected to said first side wall panels, each of said second side wall panels having at least one locking tab at the free edge thereof, each of said pair of first and second side wall panels being folded into face-to-face contact to form a pair of side walls, a pair of end walls foldably connected to said bottom wall at the other ends thereof, each of said end walls having a pair of foldably connected end flaps at either end thereof, said pairs of end flaps being sandwiched between said first and second side wall panels, said locking tab engaging with a groove provided in the bottom wall to maintain the tray in an erect condition;

(b) said tray having a plurality of runners disposed in spaced relationship upon the bottom wall to provide a rigid deck for the pallet, the ends of each of said runners being held in position by recesses provided in the second side wall panels, each of said runners having at least two support blocks which are accommodated in apertures provided in the bottom wall of the tray whereby legs are provided for the pallet and entry is afforded the tines of a forklift truck.

* * * * *